US012708202B2

(12) United States Patent
Gonzalez et al.

(10) Patent No.: US 12,708,202 B2
(45) Date of Patent: Aug. 18, 2026

(54) SHELVING SUPPORT BRACKET ASSEMBLY

(71) Applicant: SPG International, LLC, Atlanta, GA (US)

(72) Inventors: Arturo Gonzalez, Lilburn, GA (US); Steven M. Kessell, Loganville, GA (US); Michael D. Potter, Marydel, DE (US)

(73) Assignee: SPG International, LLC, Atlanta, GA (US)

( * ) Notice: Subject to any disclaimer, the term of this patent is extended or adjusted under 35 U.S.C. 154(b) by 18 days.

(21) Appl. No.: 18/901,805

(22) Filed: Sep. 30, 2024

(65) Prior Publication Data

US 2025/0017367 A1 Jan. 16, 2025

Related U.S. Application Data

(63) Continuation of application No. 18/211,114, filed on Jun. 16, 2023, now Pat. No. 12,102,225, which is a (Continued)

(51) Int. Cl.
*A47B 57/48* (2006.01)
*A47B 96/06* (2006.01)
(Continued)

(52) U.S. Cl.
CPC ..... *A47B 57/485* (2013.01); *A47B 96/06* (2013.01); *A47B 96/061* (2013.01);
(Continued)

(58) Field of Classification Search
CPC ..... A47B 57/485; A47B 57/00; A47B 57/30; A47B 96/06; A47B 96/061; A47B 96/1408
See application file for complete search history.

(56) References Cited

U.S. PATENT DOCUMENTS 239,909 A 4/1881 Woodward
291,030 A 1/1884 Clapper
(Continued)

FOREIGN PATENT DOCUMENTS

BR MU8403219 U 8/2006
BR MU8802519 U2 5/2010
(Continued)

OTHER PUBLICATIONS

U.S. Appl. No. 13/830,962, filed Mar. 14, 2013, U.S. Pat. No. 9,119,471, Sep. 1, 2015, Arturo Gonzalez et al.
(Continued)

*Primary Examiner* — Nkeisha Smith
(74) *Attorney, Agent, or Firm* — Arnall Golden Gregory LLP

(57) ABSTRACT

A shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

17 Claims, 6 Drawing Sheets

Related U.S. Application Data continuation of application No. 17/011,681, filed on Sep. 3, 2020, now Pat. No. 11,678,741, which is a continuation of application No. 16/218,146, filed on Dec. 12, 2018, now Pat. No. 10,765,206, which is a continuation of application No. 15/678,909, filed on Aug. 16, 2017, now Pat. No. 10,194,744, which is a continuation of application No. 14/840,254, filed on Aug. 31, 2015, now Pat. No. 10,201,228, which is a continuation of application No. 13/830,962, filed on Mar. 14, 2013, now Pat. No. 9,119,471.

(51) Int. Cl.
*A47B 96/14* (2006.01)
*A47B 57/00* (2006.01)
*A47B 57/30* (2006.01)

(52) U.S. Cl.
CPC ..... *A47B 96/1408* (2013.01); *A47B 57/00* (2013.01); *A47B 57/30* (2013.01)

(56) References Cited

U.S. PATENT DOCUMENTS 309,360 A 12/1884 Roberts
663,784 A 12/1900 Porter
870,439 A 11/1907 Kade
1,288,544 A 12/1918 Farrow
1,327,748 A * 1/1920 Vanderveld ..... A47B 57/485 248/243
1,372,180 A * 3/1921 Mcfadden ..... A47B 57/485 105/317
1,424,284 A 8/1922 Dkye
1,560,122 A 11/1925 Vance
1,582,100 A 4/1926 Troppman
1,620,841 A 3/1927 Vance
1,698,974 A 1/1929 Vance
1,702,937 A 2/1929 Friedmann
1,983,858 A 12/1934 Karnes
2,008,180 A 7/1935 Moussette
2,246,090 A 6/1941 Filer
2,263,282 A 11/1941 Welch et al.
2,534,952 A 12/1950 Comer
2,693,884 A 11/1954 Gurries
2,772,846 A 12/1956 Skar
2,788,949 A 4/1957 Gurries
2,790,559 A 4/1957 Stephenson et al.
2,912,119 A 11/1959 Robinson
2,919,034 A 12/1959 Levy
2,933,196 A 4/1960 Childs
2,940,601 A 6/1960 Smith
2,940,603 A 6/1960 Riedmaier et al.
2,971,805 A 2/1961 Weiss
2,975,908 A 3/1961 Huet
2,983,389 A 5/1961 Trautmann
3,018,900 A 1/1962 Huet
RE25,156 E 4/1962 Gingher et al.
3,040,905 A 6/1962 Gingher et al.
3,044,632 A 7/1962 Schild
3,044,634 A 7/1962 Oztekin
3,057,483 A 10/1962 Derman
3,070,237 A 12/1962 Fullerton et al.
3,097,822 A 7/1963 Attwood
3,100,572 A 8/1963 Gingher et al.
3,127,146 A 3/1964 Fisher
3,130,693 A 4/1964 Shell
3,184,068 A 5/1965 Wende
3,194,528 A 7/1965 Chesley
3,199,822 A 8/1965 Ruhnke
3,207,322 A 9/1965 Pedersen
3,212,648 A * 10/1965 Baker, Jr. ..... A47B 57/50 108/108
3,216,377 A 11/1965 Gunn
3,221,678 A 12/1965 Doherty
3,229,822 A 1/1966 Janus
3,229,823 A 1/1966 Hummer
3,250,584 A 5/1966 Tassell
3,273,720 A 9/1966 Seiz
3,273,847 A 9/1966 Berman
3,294,351 A 12/1966 Rollins
3,303,937 A * 2/1967 Mcconnell ..... A47B 57/50 211/187
3,316,863 A 5/1967 Felix
3,346,126 A 10/1967 Milton et al.
3,353,684 A 11/1967 Chelsey
3,355,134 A 11/1967 Chelsey
3,358,956 A 12/1967 Thorton
3,371,798 A * 3/1968 D'Altrui ..... A47B 57/485 248/240.4
3,392,848 A * 7/1968 Mcconnell ..... A47B 57/50 248/221.12
3,450,270 A 6/1969 Brown
3,456,970 A * 7/1969 Sunasky ..... A47B 57/402 403/380
3,471,112 A 10/1969 Macdonald et al.
3,479,975 A 11/1969 Ferdinand et al.
3,495,718 A 2/1970 Romero
3,512,653 A 5/1970 Erismann
3,512,654 A * 5/1970 Jay ..... A47B 96/145 411/356
3,517,623 A 6/1970 Goldstein et al.
3,545,626 A 12/1970 Seiz
3,556,306 A 1/1971 Shell
3,561,608 A 2/1971 Weider
3,565,020 A 2/1971 Schier et al.
3,565,381 A 2/1971 Oliver
3,572,626 A 3/1971 Bertschi
3,587,867 A 6/1971 Fenwick
3,595,404 A 7/1971 Goldstein et al.
3,602,159 A 8/1971 Marschak
3,602,374 A * 8/1971 Alabaster ..... A47B 57/485 211/193
3,612,290 A 10/1971 Evans
3,612,291 A 10/1971 Skubic
3,627,247 A 12/1971 Krikorian
3,631,821 A 1/1972 Zachariou
3,645,486 A 2/1972 Ferdinand et al.
3,695,569 A 10/1972 Pullan
3,701,325 A 10/1972 Fenwick
3,702,137 A * 11/1972 Evans ..... A47B 57/487 211/187
3,730,108 A 5/1973 Stroh
3,740,776 A 6/1973 Lazarus
3,759,191 A 9/1973 Freeman
3,762,335 A * 10/1973 Baker, Jr ..... B65G 7/06 180/125
3,765,344 A 10/1973 Ferdinand et al.
3,784,025 A 1/1974 Dumit
3,793,655 A 2/1974 Harris et al.
3,827,377 A 8/1974 Aughtry, Jr.
3,854,686 A 12/1974 Konstant
3,885,675 A 5/1975 Hultenby et al.
3,993,002 A 11/1976 Stroh
4,018,167 A 4/1977 Spangler et al.
4,064,996 A 12/1977 Shillum
4,098,480 A 7/1978 Neumann
4,101,108 A 7/1978 Klein
4,109,797 A 8/1978 Brunette
4,116,509 A 9/1978 Smith
4,122,955 A 10/1978 Celms
4,146,140 A 3/1979 Suter et al.
4,150,753 A 4/1979 Stahl et al.
4,174,086 A 11/1979 Verberkmoes
4,189,123 A 2/1980 Johnson
4,190,002 A 2/1980 Redemann
4,197,950 A 4/1980 Ovitz, III
4,201,139 A 5/1980 Suttles
4,205,815 A 6/1980 Sauer et al.
4,230,052 A 10/1980 Champagne
4,285,436 A 8/1981 Konstant et al.
4,286,719 A * 9/1981 Hall ..... A47B 57/52 211/193

(56) References Cited

U.S. PATENT DOCUMENTS 4,312,086 A 1/1982 Bianco
4,332,204 A 6/1982 Hewell
4,360,181 A 11/1982 Burkholder
4,367,819 A 1/1983 Lewis
4,378,925 A 4/1983 Griffin
4,396,125 A 8/1983 Rowader
4,397,432 A 8/1983 Resetar
4,425,049 A 1/1984 Travis
4,426,011 A * 1/1984 Jay ..... A47B 96/061 211/193
4,444,323 A 4/1984 Travis
4,455,007 A 6/1984 Varon et al.
4,534,529 A 8/1985 Dorner
4,589,349 A 5/1986 Gebhardt et al.
4,592,286 A 6/1986 Trubiano
4,615,503 A 10/1986 Garfinkle
4,623,065 A 11/1986 Cooper
4,624,376 A 11/1986 Bertram
4,627,543 A 12/1986 Nicely
4,684,094 A 8/1987 Everett
4,700,916 A 10/1987 Bastian et al.
4,938,442 A 7/1990 Mastrodicasa
4,951,908 A 8/1990 Kallio
4,955,743 A * 9/1990 King ..... A47B 57/50 211/192
4,960,210 A 10/1990 Spamer
D311,858 S 11/1990 Richmond
5,022,541 A 6/1991 White
5,025,937 A 6/1991 King
5,054,404 A 10/1991 Melgers
5,069,408 A 12/1991 Bessinger
5,074,422 A 12/1991 Holtz
5,080,238 A 1/1992 Hochman
5,116,007 A 5/1992 Von Gunton et al.
5,127,342 A 7/1992 Taylor
5,161,701 A 11/1992 Berny
D331,873 S 12/1992 Finkelstein et al.
D333,059 S 2/1993 Cohn et al.
5,205,630 A 4/1993 Welch et al.
5,221,014 A 6/1993 Welch et al.
5,230,492 A 7/1993 Zwart et al.
D339,704 S 9/1993 Cohn et al.
5,263,595 A 11/1993 Hilstolsky
5,265,740 A 11/1993 Hodsden et al.
5,269,419 A 12/1993 Aldeguer et al.
5,288,046 A 2/1994 Eklof et al.
5,297,486 A 3/1994 Herrmann et al.
5,303,645 A 4/1994 Meacham
5,305,898 A 4/1994 Merl
5,346,077 A 9/1994 Randall
5,350,074 A 9/1994 Rosenband
5,351,842 A 10/1994 Remmers
5,365,860 A 11/1994 Billington, III
5,390,803 A 2/1995 McAllister
D358,321 S 5/1995 Tayar
5,415,302 A 5/1995 Carlson et al.
5,417,396 A 5/1995 Merl
5,423,251 A 6/1995 Kolvites et al.
5,437,426 A 8/1995 MacDonald
5,443,167 A 8/1995 Menaged et al.
5,454,638 A 10/1995 Bird et al.
5,456,435 A 10/1995 Sweeney
5,456,438 A 10/1995 Long
5,472,103 A 12/1995 Merl
5,477,971 A 12/1995 Howard
5,482,168 A 1/1996 Welch et al.
5,509,541 A 4/1996 Merl
5,518,127 A 5/1996 Warmack et al.
5,522,324 A 6/1996 van Gelder et al.
5,531,168 A 7/1996 Towfigh
5,575,444 A 11/1996 Otema
5,592,886 A 1/1997 Williams et al.
5,605,238 A 2/1997 Jacobs
5,611,440 A 3/1997 Møller
5,613,449 A 3/1997 Pullman
5,624,045 A * 4/1997 Highsmith ..... A47B 57/487 403/353
5,641,081 A 6/1997 Merl
5,645,257 A 7/1997 Ward
5,647,650 A 7/1997 Daugherty et al.
5,655,740 A 8/1997 Lazarus
5,680,942 A 10/1997 McAllister et al.
5,695,163 A * 12/1997 Tayar ..... A47B 96/061 248/250
5,715,957 A 2/1998 Merl
5,769,247 A 6/1998 Merl
5,794,902 A 8/1998 Henry et al.
5,797,501 A 8/1998 Von Gunten
5,797,503 A 8/1998 Stevens et al.
5,806,820 A 9/1998 Simon
5,816,419 A 10/1998 Lamson
5,833,083 A 11/1998 Miller
5,845,795 A 12/1998 Mulholland
5,868,263 A 2/1999 McAllister et al.
5,884,567 A 3/1999 Bartz, Jr.
5,908,119 A 6/1999 Kump et al.
5,915,803 A 6/1999 Daugherty et al.
5,921,190 A 7/1999 Wood
5,921,411 A 7/1999 Merl
5,921,414 A 7/1999 Burke et al.
D415,365 S 10/1999 Nicklas
5,970,887 A 10/1999 Hardy
5,979,677 A 11/1999 Simpson, II et al.
6,017,009 A 1/2000 Swartz et al.
6,019,331 A 2/2000 Hoogland et al.
6,024,333 A 2/2000 Raasch et al.
6,029,833 A 2/2000 Yeh
6,053,115 A 4/2000 Felton
6,062,401 A 5/2000 Hall et al.
6,082,690 A 7/2000 Durin et al.
6,109,461 A 8/2000 Kluge et al.
6,116,436 A 9/2000 Ferrucci et al.
6,129,224 A 10/2000 Mingers
6,158,599 A 12/2000 Lazarus
6,182,937 B1 2/2001 Sanderse
6,230,907 B1 5/2001 Stuart
6,230,910 B1 5/2001 Olsson et al.
6,241,109 B1 6/2001 Kautz et al.
6,253,687 B1 7/2001 McAllister
6,267,064 B1 7/2001 Ostertag et al.
6,269,906 B1 8/2001 Dockter et al.
6,345,795 B1 2/2002 Bartz, Jr.
6,431,090 B1 8/2002 Davis et al.
D462,541 S 9/2002 Welch
6,460,946 B1 10/2002 Beukema
6,481,678 B1 11/2002 Chong
6,510,955 B2 1/2003 Pellegrino
6,555,740 B2 4/2003 Roth et al.
6,584,916 B1 7/2003 Felton et al.
6,625,935 B1 9/2003 King et al.
6,659,295 B1 12/2003 De Land et al.
6,666,344 B1 12/2003 Schneider
6,675,725 B2 1/2004 Felton et al.
6,726,035 B2 4/2004 Zadak
RE38,517 E 5/2004 Pfeiffer et al.
6,848,589 B2 2/2005 Wood
6,851,653 B2 * 2/2005 Crowley ..... A47B 57/487 211/192
6,918,499 B2 7/2005 De Land et al.
6,932,225 B2 8/2005 Rowe
6,935,518 B2 8/2005 Winig et al.
6,971,528 B2 12/2005 Chen
7,040,494 B2 5/2006 Harper
7,086,543 B2 8/2006 Remmers
7,128,223 B1 10/2006 Sarnoff et al.
7,147,114 B2 12/2006 Sarnoff et al.
7,150,361 B2 12/2006 Calleja
7,191,907 B2 3/2007 Conway
7,191,908 B2 3/2007 De Rijk
7,258,317 B1 8/2007 Nagel
7,284,671 B1 10/2007 Doscher
7,311,211 B2 12/2007 Chung
7,350,649 B1 4/2008 Martens
7,357,362 B2 4/2008 Yang et al.

(56) References Cited

U.S. PATENT DOCUMENTS 7,378,213 B2 5/2008 Tomita et al.
7,387,212 B2 6/2008 Costa et al.
7,387,213 B1 6/2008 Smalley
7,401,705 B2 7/2008 Craft
7,404,533 B1 7/2008 Kologe
7,407,060 B2 8/2008 Swartz et al.
7,494,019 B2 * 2/2009 Kessell ..... A47B 57/06 211/186
7,497,344 B2 3/2009 Chen
7,506,772 B2 3/2009 Chen
7,523,903 B1 4/2009 Rindoks et al.
7,568,436 B2 8/2009 McAllister et al.
7,654,497 B1 2/2010 Karan
7,677,514 B1 3/2010 Palmer
7,762,411 B2 7/2010 Hilburn et al.
7,810,438 B2 10/2010 Ryberg
7,832,571 B2 11/2010 Felsenthal
7,900,783 B2 3/2011 Fernandez et al.
7,967,156 B2 6/2011 Hsu
7,967,268 B2 6/2011 Herron, III et al.
7,992,731 B2 8/2011 Mcallister et al.
8,025,163 B2 9/2011 McAllister et al.
8,028,846 B2 10/2011 Peota et al.
8,087,521 B2 1/2012 Schwartzkopf et al.
8,113,678 B2 2/2012 Babcock et al.
8,118,181 B2 2/2012 Shinozaki
8,141,724 B2 3/2012 Northam et al.
8,152,119 B2 4/2012 Pfund et al.
8,235,339 B2 8/2012 Selvidge et al.
8,272,819 B1 9/2012 Adams
8,424,466 B2 4/2013 Botkin
8,468,844 B2 6/2013 Nagel et al.
8,584,873 B2 11/2013 Horn et al.
8,596,590 B2 12/2013 McCoy
8,602,372 B2 12/2013 Yu et al.
8,646,624 B2 2/2014 Fernandez et al.
D702,467 S 4/2014 Huang et al.
8,967,576 B2 3/2015 Knoll et al.
9,119,471 B2 9/2015 Gonzalez et al.
9,173,506 B2 11/2015 Andersson et al.
9,277,814 B2 3/2016 Winker
9,339,108 B2 5/2016 Zang et al.
9,770,122 B2 9/2017 Gonzalez et al.
D808,200 S 1/2018 Davis et al.
9,883,755 B2 2/2018 Gonzalez et al.
9,961,995 B2 5/2018 Kam
10,104,987 B2 10/2018 Gonzalez et al.
10,159,339 B1 * 12/2018 Powell ..... A47B 57/485
10,159,340 B2 12/2018 Gonzalez et al.
10,194,744 B2 2/2019 Gonzalez et al.
10,201,228 B2 2/2019 Gonzalez et al.
10,470,565 B1 * 11/2019 Levi ..... A47F 5/103
10,765,206 B2 9/2020 Gonzalez et al.
2002/0104938 A1 8/2002 Simard
2003/0037712 A1 2/2003 Welch et al.
2003/0160012 A1 8/2003 Kanouchi et al.
2003/0234231 A1 12/2003 Rowe
2004/0020885 A1 2/2004 Newman
2004/0045919 A1 3/2004 Remmers
2004/0050814 A1 3/2004 Roush et al.
2004/0154498 A1 8/2004 Borgen et al.
2004/0159622 A1 8/2004 Craft et al.
2004/0173549 A1 * 9/2004 Herron, III ..... A47B 96/061 211/90.02
2004/0182805 A1 9/2004 Harper
2005/0045787 A1 3/2005 Magnusson
2005/0056604 A1 3/2005 Chen
2005/0092706 A1 5/2005 Chang
2005/0103733 A1 5/2005 Saltzberg et al.
2005/0103734 A1 5/2005 Saltzberg et al.
2005/0127017 A1 6/2005 Kessel et al.
2005/0145147 A1 7/2005 Costa et al.
2005/0145588 A1 7/2005 Stitchick et al.
2005/0150850 A1 7/2005 Stitchick et al.
2005/0199568 A1 9/2005 Gay et al.
2006/0054577 A1 3/2006 Strating et al.
2006/0091088 A1 5/2006 McCoy
2006/0175495 A1 8/2006 Gregory
2006/0213849 A1 9/2006 Bienick
2007/0110511 A1 5/2007 Chen
2007/0114348 A1 5/2007 Nawrocki
2007/0138362 A1 6/2007 McAllister et al.
2007/0241072 A1 10/2007 Bryant et al.
2007/0295681 A1 12/2007 Colin
2008/0047914 A1 2/2008 Young
2008/0083685 A1 4/2008 Chen
2008/0128373 A1 6/2008 Chang et al.
2008/0142463 A1 6/2008 Johnson
2008/0179267 A1 7/2008 Johnson
2008/0217496 A1 9/2008 Wooten
2008/0237426 A1 10/2008 Walters
2009/0014400 A1 1/2009 Nawrocki
2009/0139943 A1 6/2009 Fernandez
2010/0032394 A1 2/2010 Wang
2010/0140202 A1 6/2010 Janis
2010/0155353 A1 6/2010 McAllister et al.
2010/0163504 A1 7/2010 Freeman
2010/0200716 A1 8/2010 White, III
2010/0327135 A1 12/2010 Selvidge et al.
2011/0168651 A1 7/2011 Stenftenagel et al.
2011/0220602 A1 9/2011 Chen
2012/0175330 A1 7/2012 Nicholls et al.
2012/0255924 A1 10/2012 Kologe
2012/0273447 A1 11/2012 Stitchick et al.
2012/0292271 A1 11/2012 Bevelacqua
2013/0020272 A1 1/2013 Kropveld
2013/0020452 A1 1/2013 Yu et al.
2013/0021391 A1 1/2013 Rui
2013/0062300 A1 * 3/2013 Drake ..... A47F 5/0884 211/183
2014/0263125 A1 9/2014 Gonzalez et al.
2015/0335155 A1 11/2015 Winker
2015/0366339 A1 12/2015 Gonzalez et al.
2017/0310090 A1 10/2017 Woodley et al.
2017/0332782 A1 11/2017 Castro
2017/0340108 A1 11/2017 Gonzalez et al.
2017/0340142 A1 11/2017 Gonzalez et al.

FOREIGN PATENT DOCUMENTS

CN 1132999 A 10/1996
CN 101627271 A 1/2010
CN 101868166 A 10/2010
CN 102131426 A 7/2011
CN 101512857 B 3/2012
CN 102949019 A 3/2013
DE 1138902 B 10/1962
DE 2824605 12/1979
DE 9109395 U1 9/1991
DE 20215552 U1 2/2003
FR 1515478 A 3/1968
GB 608480 A 9/1948
GB 1025357 A 4/1966
GB 1149568 A 4/1969
GB 2194134 A 3/1988
KR 19980011353 U 5/1998
KR 101267731 B1 5/2013
WO WO-95/29613 11/1995
WO WO-2003/088782 A2 10/2003
WO WO-2005/046401 5/2005
WO WO-2013/071977 5/2013
WO PCT/US2014/26525 3/2014

OTHER PUBLICATIONS

U.S. Appl. No. 14/840,254, filed Aug. 31, 2015, U.S. Pat. No. 10,201,228, Feb. 12, 2019, Arturo Gonzalez et al.
U.S. Appl. No. 15/673,119, filed Aug. 9, 2017, U.S. Pat. No. 10,159,340, Dec. 25, 2018, Arturo Gonzalez et al.
U.S. Appl. No. 15/678,909, filed Aug. 16, 2017, U.S. Pat. No. 10,194,744, Feb. 5, 2019, Arturo Gonzalez et al.
U.S. Appl. No. 16/218,146, filed Dec. 12, 2018, U.S. Pat. No. 10,765,206, Sep. 8, 2020, Arturo Gonzalez et al.

(56) References Cited

OTHER PUBLICATIONS

U.S. Appl. No. 17/011,681, filed Sep. 3, 2020, U.S. Pat. No. 11,678,741, Jun. 20, 2023, Arturo Gonzalez et al.
U.S. Appl. No. 17/231,232, filed Apr, 15, 2021, Arturo Gonzalez et al.
U.S. Appl. No. 18/211,114, filed Jun. 16, 2023, U.S. Pat. No. 12,102,225, Oct. 1, 2024, Arturo Gonzalez et al.
"Button-On Cantilever Rack Specification," webpage, https://web.archive.org/web/20061019070526/http://www.jarke.com/products/cantilever/medium_load/button_on/specifications/buttonp1.htm; Jarke, 5b4Prospect Heights, IL, 2006, produced by InterMetro Industries Corp in Case No. 13:18-cv-00116, *SPG International,LLC* v. *InterMetro Industries Corp*, (3 pages).
"Cantilever Metal Storage System," E-Z Shelving Systems, Inc., Merriam, KS, Product Guide Specification, Aug. 2011 (21 pages).
"Cantilever Racks," All American Rack Company Warehouse Pallet Rack & Shelving (www.aarack.com/cantilever-racks/cantilever-racks/), produced by InterMetro Industries Corp in Case No. 13:18-cv-00116, *SPG International, LLC* v. *InterMetro IndustriesCorp* (2 pages).
"Cantilever Shelving—New Age Industrial;" [retrieved on May 31, 2018]. Retrieved from the Internet: <URL: www.newageindustrial.com/PublicStore/Catalog/CategoryInfo.aspx?cid=191&sort=Name&itemsperpage=36&view=Grid&currentpage=1>. (11 pages).
"Cantilever Shelving System," catalog, Nexel Industries Inc., believed to be available to the public before Mar. 14, 2013, Nexelwire.com, (1 page).
"Cantilever Shelving Unit Assembly Instruction," Nexel Industries, instruction sheet, assumed publicly available prior to 2011, produced by InterMetro Industries Corp in Case No. 13:18-cv-00116, *SPG International, LLC* v. *InterMetro Industries Corp*,(2 pages).
"Cantilever Shelving," Eagle Group, Clayton, DE, catalog, 2005, produced by InterMetro Industries Corp in Case No. 13:18-cv-00116, *SPG International, LLC* v. *InterMetro Industries Corp*, (4 pages).
"Cantilever," unreferenced image, produced by InterMetro Industries Corp in Case No. 13:18-cv-00116, *SPG International, LLC* v. *InterMetro Industries Corp* (1 page).
"Cantilevered Shelving System—Heavy Duty Components," Eagle Group, Clayton, DE, specification sheet, 2010, produced by InterMetro Industries Corp in Case No. 13:18-cv-00116, *SPG International, LLC* v. *InterMetro Industries Corp*, (2 pages).
"Chapter 3—Installing FlexWorks Accessories," Lista International Corporation, Holliston, MA, guide, 2000, produced by InterMetro Industries Corp in Case No. 13:18-cv-00116, *SPG International, LLC* v. *InterMetro Industries Corp*, (14 pages).
"Corrosion Resistant Cantilever Rack Upright," website, Global Industrial, Oct. 17, 2011, globalindustrial.com, (3 pages).
"Corrosion Resistant Cantilever Rack," website, Global Industrial, Nov. 18, 2011, globalindustrial.com, (2 pages).
"Corrosion Resistant Cantilever Rack—Adjustable Width Uprights & Frame (Only)," Global Industrial, 2011, Port Nashington, NY, produced by InterMetro Industries Corp in Case No. 13:18-cv-00116, *SPG International, LLC* v. *InterMetro Industries Corp*.,(12 pages).
"E-Z for 50 Years, Cantilever Shelving & Hardware," E-Z Shelving Systems, Inc., Merriam, KS, catalog, 2008, produced by InterMetro Industries Corp in Case No. 13:18-cv-00116, *SPG International, LLC* v. *InterMetro Industries Corp* (4 pages).
"E-Z Shelving Systems Basic Components," E-Z Shelving Systems, Inc., Merriam, KS, produced by InterMetro Industries Corp in Case No. 13:18-cv-00116, *SPG International, LLC* v. *Inte5b4rMetro Industries Corp* (1 page).
"E-Z Walk-In Cooler/Freezer Shelving Systems," E-Z Shelving Systems, Inc., Merriam, KS, May 7, 2016, produced by InterMetro Industries Corp in Case No. 13:18-cv-00116, *SPG International, LLC* v. *InterMetro Industries Corp* (8 pages).
"Foodservice Cantilever Metal Storage System," E-Z Shelving Systems, Inc., Merriam, KS, Product Guide Specification, Aug. 2011 (19 pages).
"FreedomRail Installation Guide," Organized Living, Cincinnati, OH, guide, 2009, produced by InterMetro Industries corp in Case No. 13:18-cv-00116, *SPG International, LLC* v. *InterMetro Industries Corp*, (3 pages).
"Freestyle Modular Cantilever Shelving System," SPG International, LLC, Covington, GA, specification, 2016, produced by InterMetro Industries Corp in Case No. 13:18-cv-00116, *SPG International, LLC* v. *InterMetro Industries Corp*, (9 pages).
"HD Super Work Center With Overhead," InterMetro Industries Corporation, Wilkes-Bane, PA, specification sheet, 1999, produced by InterMetro Industries Corp in Case No. 13:18-cv-00116, *SPG International, LLC* v. *InterMetro Industries Corp*, (2 pages).
"Material Handling and Industrial Storage Solutions," SPG International, LLC, Covington, GA, Catalog, 2010, (97 pages).
"Material Handling and Industrial Storage Solutions," SPG International, LLC, Covington, GA, Catalog, 2010, produced by InterMetro Industries Corp in Case No. 13:18-cv-00116, *SPG International, LLC* v. *InterMetro Industries Corp*, (27 pages).
"Metro Cantilevered Freestanding Shelving System," InterMetro Industries Corp., article, Wilkes-Barre, PA, 1993, produced by InterMetro Industries Corp in Case No. 13:18-cv-00116, *SPG International, LLC* v. *InterMetro Industries Corp*, (5 pages).
"Metro Workspace Adjustable Workstations", InterMetro Industries Corporation, Wilkes-Barre, PA, 2001, produced by InterMetro Industries Corp in Case No. 13:18-cv-00116, *SPG International, LLC* v. *InterMetro Industries Corp* (4 pages).
"New Age Industrial Aluminum Solutions,"New Age Industrial Corporation, Inc., catalog, 2012 (72 pages).
"New Age Industrial—Cantilevered Shelving," YouTube page, Apr. 16, 2011 (www.youtube.com/watch?v=Jm5aMXPcTsl) (2 pages).
"Pick Racks, Trucks & Cantilever Shelving," produced by InterMetro Industries Corp in Case No. 13:18-cv-00116, *SPG International, LLC* v. *InterMetro Industries Corp* (1 page).
"Quick Change Cantilever System," New Age Industrial Corp., Inc., Norton, Kansas, produced by InterMetro Industries Corp in Case No. 13:18-cv-00116, *SPG International, LLC* v. *InterMetro Industries Corp* (2 pages).
"Sandwich Unit Refrigerator Model: SW48-12," Continental Refrigerator, Bensalem, PA, catalog, 2013, produced by InterMetro Industries Corp in Case No. 13:18-cv-00116, *SPG International, LLC* v. *InterMetro Industries Corp* (2 pages).
"Sandwich Unit Refrigerator Model: SW48-12-FB," Continental Refrigerator, Bensalem, PA, catalog, 2013 (2 pages).
"Sandwich Unit Refrigerator Model: SW48-12M-Fb-D," Continental Refrigerator, Bensalem, PA, catalog, 2013 (2 pages).
"Shelf Types," catalog, Nexel Industries Inc., Sep. 28, 2010, (58 pages).
"Shelving and Sheb68lving Solutions," Eagle Group, Clayton, DE, catalog, 2009, produced by InterMetro Industries Corp in Case No. 13:18-cv-00116, *SPG international, LLC* v. *InterMetro Industries Corp*, (16 pages).
"Shelving," Newb68 Age Industrial (www.newageindustrial.com:80/CategoryDetail.aspx?ISC_Category=Shelving), 2008 (1 page).
"Storage and Handling Equipment," catalog, Nexel Industries Inc., Jul. 24, 2010, http://www.nexelwire.com:80/catalog/, (1 page).
"Super Erecta Shelf Post—Type and Direct Wall Mounts," InterMetro Industries, Wilkes-Bane, PA, specification sheet, 2000, produced by InterMetro Industries Corp in Case No. 13:18-cv- 00116, *SPG International, LLC* v. *InterMetro Industries Corp*, (2 pages).
Wire Basket with Brackets 36"×16", Global Equipment Company, Inc., <https://web.archive.org/web/20120507140028/http://www.globalindustria\'85->; web page, 2012, produced by InterMetro Industries Corp in Case No. 13:18-cv-00116, *SPGInternational, LLC* v. *InterMetro Industries Corp*, (3 pages).
Chinese Application No. 201480024336.X, first Office Action and Search Report from the State Intellectual Property Office of the People's Republic of China, dated Dec. 28, 2016 (16 pages).
Chinese Application No. 201480024336.X; second Office Action and Search Report from the State Intellectual Property Office of the People's Republic of China, dated Aug. 21, 2017 (8 pages).
Chinese Application No. 201480060558.7, first Office Action and Search Report from the State Intellectual Property Office of the People's Republic of China, dated Jun. 27, 2017, produced by

(56) References Cited

OTHER PUBLICATIONS

InterMetro Industries Corp in Case No. 13:18-cv-00116, *SPGInternational, LLC* v. *InterMetro Industries Corp*, (10 pages).
Chinese Application No. 21480024336.X, first Office Action and Search Report from the State Intellectual Property Office of the People's Republic of China, dated Dec. 28, 2016, produced by InterMetro Industries Corp in Case No. 13:18-cv-00116, *SPGInternational, LLC* v. *InterMetro Industries Corp*, (16 pages).
Defendant InterMetro Industries Corp.'s Invalidity Contentions, U.S. District Court, Middle District of Tennessee Nashville Division, *SPG International, LLC* v. *Intermetro Industries Corp*, Case No. 13:18-cv-00116, (28 pages).
Defendant's Amended Answer and Counterclaims, U.S. District Court, Middle District of Tennessee Nashville Division, *SPG International, LLC* v. *Intermetro Industries Corp*, Case No. 13:18-cv-00116, filed Apr. 5, 2018 (18 pages).
Eagle Group, "Cantilever Shelving," article, EG7010 Rev. 3 (2005) 4 pages, www.eaglegrp.com.
Exhibit A, "Asserted Claims 1, 2, 3, 5, 7, 9, 11, 12, 14 and 16 of U.S. Pat. No. 9,883,755 are Invalid in View of Karnes," submitted by InterMetro Industries Corp in Case No. 13:18-cv-00116, *SPG International, LLC* v. *InterMetro Industries Corp*, 2018, (18 pages).
Exhibit B, "The Asserted Claims of U.S. Pat. No. 9,883,755 are Invalid Over Jensen et al. in View of Kessel et al.," submitted by InterMetro Industries Corp in Case No. 13:18-cv-00116, *SPG International, LLC* v. *InterMetro Industries Corp*, 2018, (26 pages).
Exhibit C, "The Asserted Claims of U.S. Pat. No. 9,883,755 are Invalid Over Jensen et al. in View of Mason," submitted by InterMetro Industries Corp in Case No. 13:18-cv-00116, *SPG International, LLC* v. *InterMetro Industries Corp*, 2018, (26 pages).
Exhibit D, "The Asserted Claims of U.S. Pat. No. 9,883,755 are Invalid Over Andersson et al. in View of Kessel et al.," submitted by InterMetro Industries Corp in Case No. 13:18-cv-00116, *SPG International, LLC* v. *InterMetro Industries Corp*, 2018, (26 pages).
Exhibit E, "The Asserted Claims of U.S. Pat. No. 9,883,755 are Invalid Over Andersson et al. in View of Mason," submitted by InterMetro Industries Corp in Case No. 13:18-cv-00116, *SPG International, LLC* v. *InterMetro Industries Corp*, 2018, (26 pages).
Exhibit F, "Asserted Claims 1-3, 5, 7-12, 14-16 and 18 of U.S. Pat. No. 9,883,755 are Invalid under 35 U.S.C. 112," submitted by InterMetro Industries Corp in Case No. 13:18-cv-00116, *SPG International, LLC* v. *InterMetro Industries Corp*, 2018, (10 pages).
Extended European Search Report for Application No. 14775083.0 dated Feb. 15, 2017 (8 pages).
Extended European Search Report for Application No. 14775083.0 dated Jun. 21, 2017 (9 pages).
Extended European Search Report for Application No. 14851078.7, dated Jun. 28, 2017, produced by InterMetro Industries Corp in Case No. 13:18-cv-00116, *SPG International, LLC* v. *InterMetro Industries Corp*, (8 pages).
Extended European Search Report for Application No. 18156976.5, dated May 15, 2018, European Patent Office, produced by InterMetro Industries Corp in Case No. 13:18-cv-00116, *SPG International, LLC* v. *InterMetro Industries Corp*, (4 pages).
EZ Shelving Systems, Inc., "Manufacturer of Space-Saving Cantilever Shelving & Hardware," catalog (2005) pp. 1-8, Merriam, USA website: www.e-zshelving.com.
EZ Shelving Systems, Inc., "Manufacturer of Space-Saving Cantilever Shelving & Hardware," catalog (2008) pp. 1-4, Merriam, USA website: www.e-zshelving.com.
International Search Report and Written Opinion received in International Patent Application No. PCT/US2014/026525 dated Jul. 28, 2014 (11 pages).
International Search Report and Written Opinion received in International Patent Application No. PCT/US2014/058308, dated Jan. 5, 2015, produced by InterMetro Industries Corp in Case No. 13:18-cv-00116, *SPG International, LLC* v. *InterMetroIndustries Corp*, (9 pages).
Limited Warranty and Assembly Instructions, Nexel Industries Inc., believed to be available to the public before Mar. 14, 2013, (3 pages).
Metro, "Metro Cantilevered Freestanding Shelving System," article (2001) 5 pages, www.metro.com.
Modern Equipment Company, Inc., "Instructions for Assembling Meco Omaha Series 2000 Medium-Heavy Duty Cantilever Rack" online brochure (2013) 6 pages, www.meco-omaha.com.
Modern Equipment Company, Inc., "Meco Omaha Cantilever Rack, Buyers Guide" online brochure (2001) 12 pages.
Select components and views of a shelving system, Global Industrial (www.globalindustrial.com), produced by InterMetro Industries Corp in Case No. 13:18-cv-00116, *SPG International, LLC* v. *InterMetro Industries Corp* (19 pages).
Statement of Relevance with photo of shelving system asserted by Defendant in *SPG International, LLC* v. *Intermetro Industries Corp*, Case No. 3:18-cv-00116 as a cantilever shelving system made by Nexel Industries, Inc. and available to the publicsince at least about Oct. 2011, (2 pages).
Statement of Relevance with photos showing select components of a cantilever shelving system of Nexel Products, Inc., believed to be available to the public before Mar. 14, 2013, (11 pages).
U.S. Appl. No. 13/830,962, dated Apr. 27, 2015, USPTO Notice of Allowance.
U.S. Appl. No. 14/840,254, dated Sep. 29, 2017, USPTO Office Action, produced by InterMetro Industries Corp in Case No. 13:18-cv-00116, *SPG International, LLC* v. *InterMetro Industries Corp*, (8 pages).
U.S. Appl. No. 14/840,254, dated May 9, 2018, USPTO Notice of Allowance.
U.S. Appl. No. 14/840,254, dated Jun. 7, 2018, USPTO Corrected/Supplemental Notice of Allowance.
U.S. Appl. No. 14/840,254, dated Jul. 27, 2018, USPTO Supplemental Notice of Allowance.
U.S. Appl. No. 14/840,254, dated Aug. 13, 2018, USPTO Notice of Allowance.
U.S. Appl. No. 14/840,254, dated Jan. 14, 2019, USPTO Notice of Allowance.
U.S. Appl. No. 15/673,119, dated Oct. 2, 2017, USPTO Office Action, produced by InterMetro Industries Corp in Case No. 13:18-cv-00116, *SPG International, LLC* v. *InterMetro Industries Corp*, (14 pages).
U.S. Appl. No. 15/673,119, dated Oct. 23, 2018, USPTO Notice of Allowance.
U.S. Appl. No. 15/673,119, filed Aug. 9, 2017, Arturo Gonzalez et al., entitled "Support Bracket," produced by InterMetro Industries Corp in Case No. 13:18-cv-00116, *SPG International, LLC* v. *InterMetro Industries Corp*, (25 pages).
U.S. Appl. No. 15/675,368, dated Oct. 6, 2017, USPTO Office Action (7 pages).
U.S. Appl. No. 15/678,909, dated Oct. 6, 2017, USPTO Office Action, produced by InterMetro Industries Corp in Case No. 13:18-cv-00116, *SPG International, LLC* v. *InterMetro Industries Corp*, (20 pages).
U.S. Appl. No. 15/678,909, dated Sep. 17, 2018, USPTO Notice of Allowance.
U.S. Appl. No. 15/678,909, dated Oct. 17, 2018, USPTO Corrected Notice of Allowance.
U.S. Appl. No. 15/678,909, filed Aug. 16, 2017, Arturo Gonzalez et al., entitled "Support Bracket," produced by InterMetro Industries Corp in Case No. 13:18-cv-00116, *SPG International, LLC* v. *InterMetro Industries Corp*, (23 pages).
U.S. Appl. No. 16/218,146, dated May 7, 2020, USPTO Notice of Allowance.
U.S. Appl. No. 17/011,681, dated Nov. 14, 2022, USPTO Notice of Allowance.
U.S. Appl. No. 17/011,681, dated Jan. 25, 2023, USPTO Notice of Allowance.
U.S. Appl. No. 17/011,681, dated May 17, 2023, USPTO Corrected Notice of Allowance.
U.S. Appl. No. 18/211,114, dated Jun. 24, 2024, USPTO Notice of Allowance.

(56) References Cited

OTHER PUBLICATIONS

European Application No. 14775083.0, dated Jan. 28, 2025, Communication pursuant to Article 94(3) EPC.

* cited by examiner

SHELVING SUPPORT BRACKET ASSEMBLY

INCORPORATION BY REFERENCE TO RELATED APPLICATIONS

This application is a continuation of U.S. application Ser. No. 18/211,114 filed on Jun. 16, 2023, which is a continuation of U.S. application Ser. No. 17/011,681 filed on Sep. 3, 2020, granted as U.S. Pat. No. 11,678,741, which is a continuation of U.S. application Ser. No. 16/218,146 filed on Dec. 12, 2018, granted as U.S. Pat. No. 10,765,206, which is a continuation of U.S. application Ser. No. 15/678,909 filed on Aug. 16, 2017, granted as U.S. Pat. No. 10,194,744, which is a continuation of U.S. application Ser. No. 14/840,254 filed on Aug. 31, 2015, granted as U.S. Pat. No. 10,201,228, which is a continuation of U.S. application Ser. No. 13/830,962 filed on Mar. 14, 2013, granted as U.S. Pat. No. 9,119,471. The entire contents of these applications are incorporated herein by reference in their entirety.

FIELD OF THE INVENTION

The present invention relates to support brackets, and more particularly to support brackets for shelving systems.

BACKGROUND

Strength and reliability are important issues relevant to shelving systems. In many conventional shelving system designs, a tradeoff exists between strength and reliability and other features, including manufacturability, material costs, and adjustability. Often times, individual shelves experience loading conditions that cause them to fail prematurely. Examples of failure include plastic (i.e., non-elastic) deformation due to bending or buckling, dynamic fracture, and fatigue-induced fracture. Cantilevered shelves are particularly susceptible to these types of failure when subjected to repeated impact loading, for example, when heavy loads are dropped onto the shelf from an appreciable height. Such failure leads to undesirable downtime, repair, or replacement, and the costs associated therewith.

SUMMARY

In one embodiment a shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is adjacent the first retention member. The support bracket further includes a support portion extending from the attachment portion and formed to be disposed substantially about the support member.

In one embodiment a shelving system includes a support post having a mounting surface and a plurality of vertically spaced retention members extending from the mounting surface. A shelf includes a bracket member configured for coupling to a first of the vertically spaced retention members and a support member secured to the bracket member. A support bracket includes an attachment portion having an aperture therethrough formed to receive a second of the vertically spaced retention members, in which the second retention member is adjacent the first retention member. The support bracket further includes a support portion comprising a generally C-shaped region forming a recess. The C-shaped region is formed to be disposed substantially about and to couple to the support member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is spaced from the first retention member along a length of the support post. The support bracket further includes a support portion extending from the attachment portion and configured for supporting the support member.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
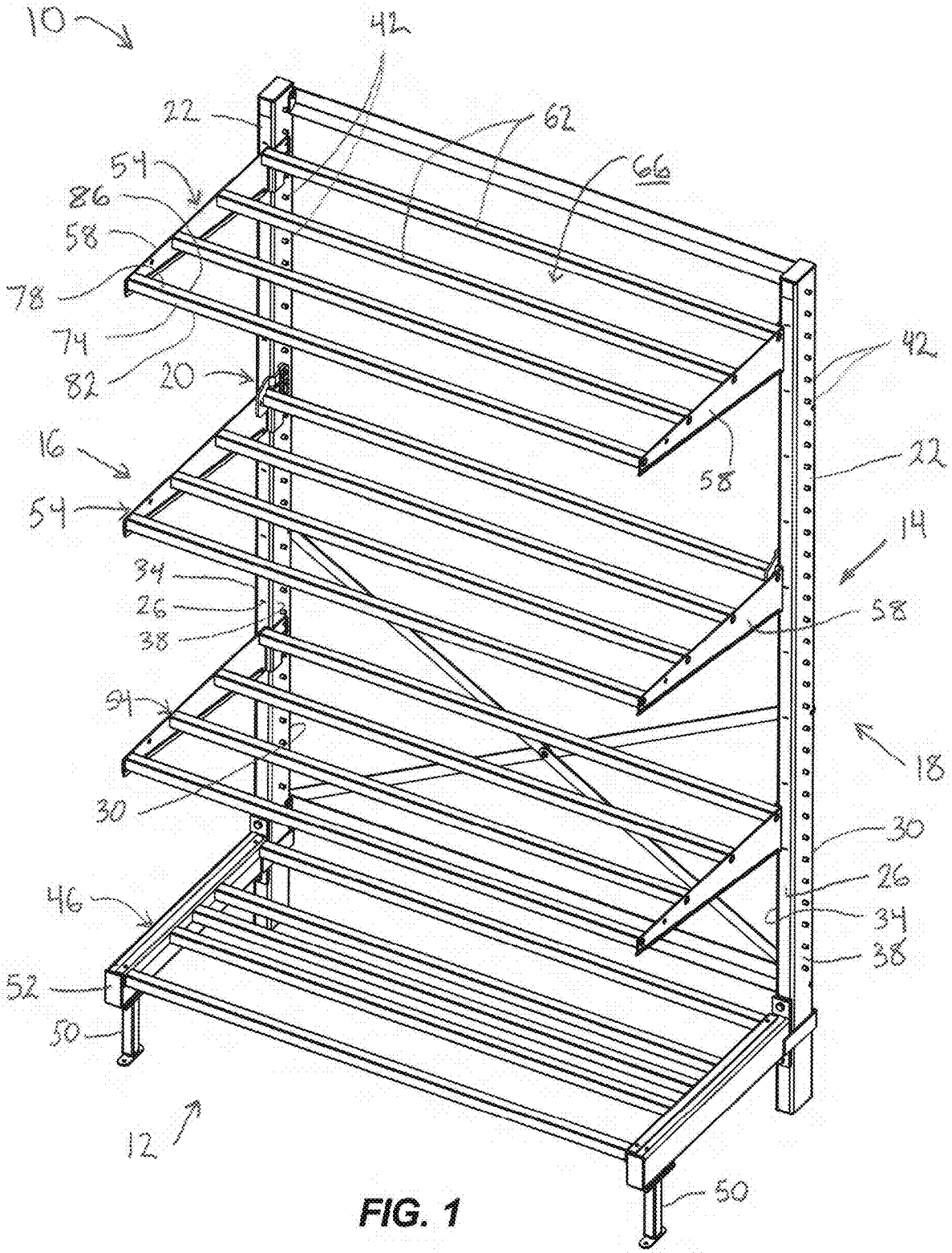
FIG. 1 is a perspective view of a shelving system including a support bracket.

FIG. 1 illustrates an exemplary shelving system 10 including one or more support brackets 20. The shelving system 10 is referenced herein with respect to a proximal end 12, a distal end 14, a left side 16, and a right side 18, the left and right sides 16, 18 referenced when viewed in the distal direction. The shelving system 10 includes a pair of vertical support posts 22 (i.e., left and right support posts 22) erected with respect to a ground or other support surface. Each post 22 defines a proximal side 26, a distal side 30, a left side 34, and a right side 38, and includes a plurality of vertically spaced retention members 42 in the form of support pins extending therethrough and protruding laterally from the left and right sides 34, 38. In the illustrated embodiment, the support pins 42 are spaced a distance of between about one inch and about four inches along the length of each post 22. In other embodiments, the support pins 42 can be spaced equally or unequally from each other. Each pin 42 is preferably press-fit in place but can be secured in any suitable manner generally known to those of skill in the art, e.g., welding, etc. In additional embodiments, the retention members can be in the form of hooks, ledges, or other shaped protrusions and forms affixed or otherwise coupled to each post 22.

A bottom shelf 46 nearest the ground or other support surface extends from the proximal side 26 of the posts 22 and includes a pair of support legs 50 at or near an end 52 that contacts the ground or other support surface to provide stability for the shelving system 10.

With continued reference to FIG. 1, the shelving system 10 includes one or more shelves 54 configured for coupling to the support posts 22. Each shelf 54 is mounted to the posts 22 by way of the support pins 42 and includes lateral brackets 58 with a plurality of support members 62 in the form of cross-braces extending therebetween to provide a generally planar support surface 66 for the shelf 54. Each of the support members 62 includes a proximal side 74 substantially perpendicular to the planar support surface 66, a top side 78 adjacent the planar support surface 66, a bottom side 82 opposite the top side 78, and a distal side 86 opposite the proximal side 74. As such, the illustrated support members 62 have a generally rectangular cross-section. However, other embodiments of a shelf 54 can include support members 62 having any other regularly or irregularly shaped cross-section, while still maintaining generally designated sides. For example, a support member having a circular cross-section (not shown) is oriented by definition to include top, bottom, front, and rear sides despite not having distinct surfaces separated by corners. In yet other embodiments, the lateral brackets 58 can be connected by a frame, sheet, series of bars or poles, mesh, screen, grate, or other form of support member extending between the lateral brackets 58 for purposes of supporting weight, through either direct contact or optionally through a separate supporting surface cover or platform upon which to store and/or display articles.

Figure 2:
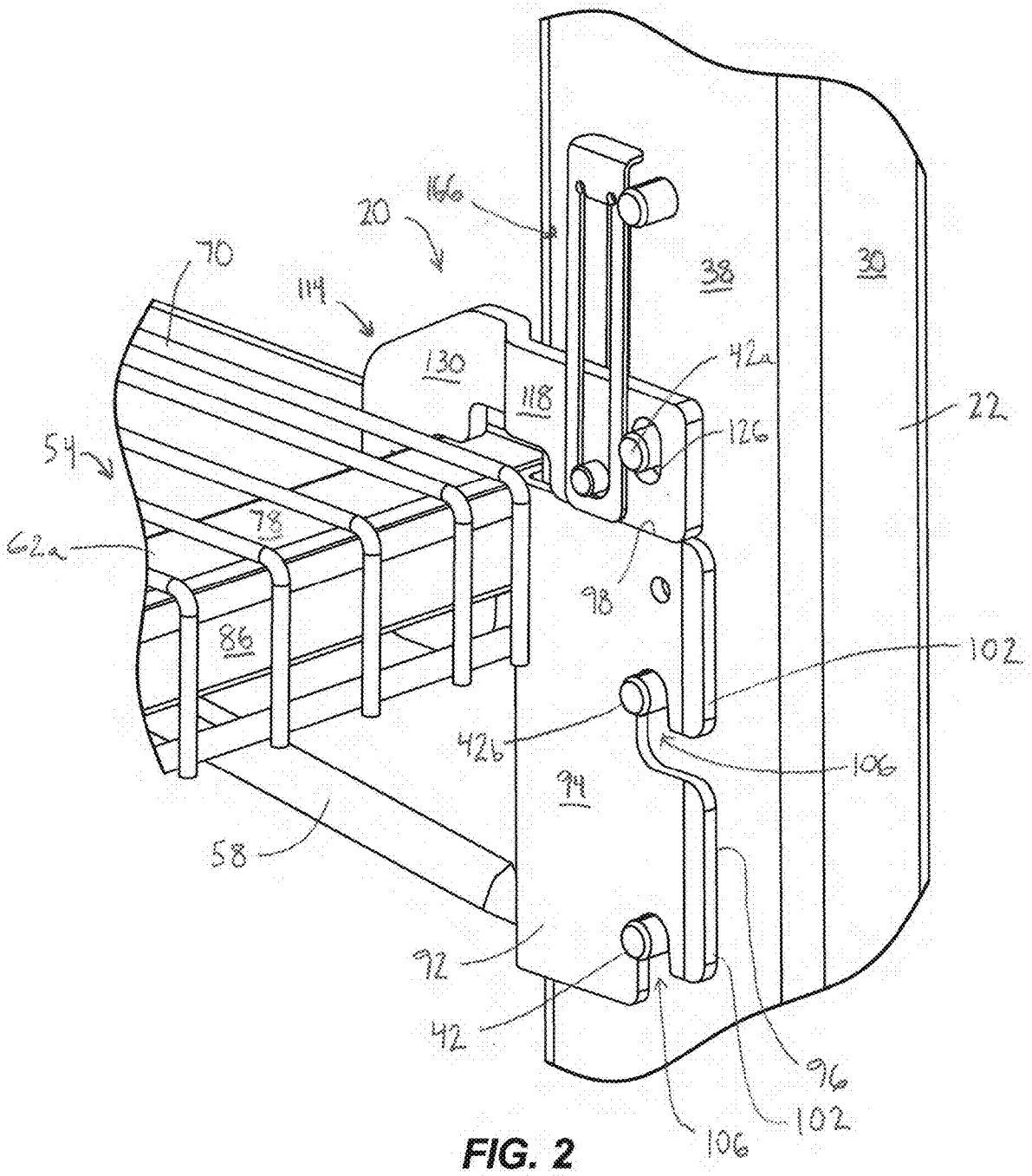
FIG. 2 is a partial perspective view of the shelving system showing the bracket identified in FIG. 1.
Figure 3:
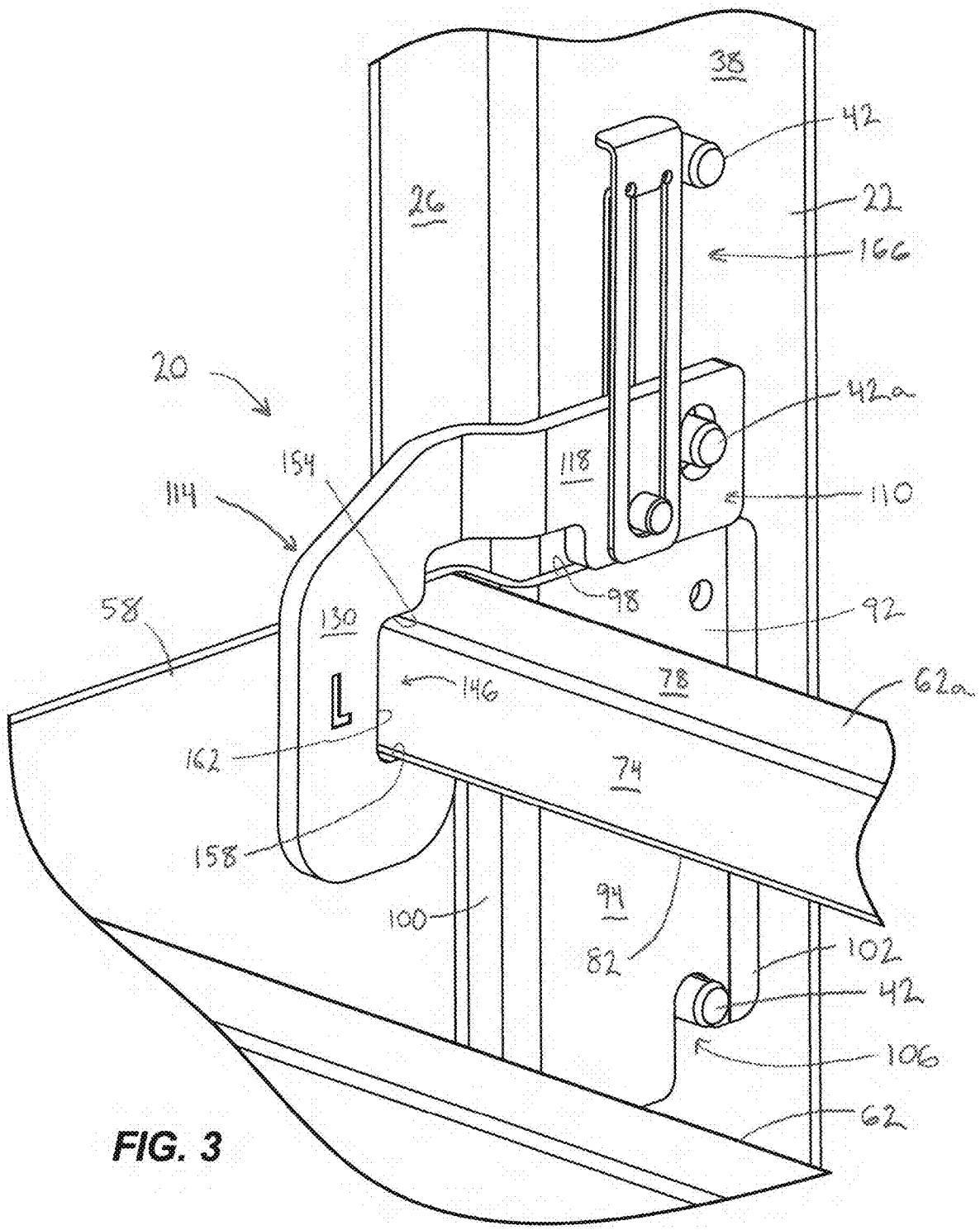
FIG. 3 is another partial perspective view of the shelving system showing the bracket identified in FIG. 1.

Referring to FIGS. 2 and 3, each of the lateral brackets 58 includes a flange member 92 having a first side 94 opposite the support post 22 when coupled thereto, a second side 96 adjacent the support post 22, and a top side 98 extending between the first side 94 and the second side 96. The flange member 92 also includes a bearing surface 100 adjacent and generally parallel to the proximal side 26 of the support post 22. Contact between the bearing surface 100 and the proximal side 26 prevents rotation of the shelf 54 on the post 22 due to the weight of the shelf 54 and additional loading placed upon the support members 62.

In the illustrated embodiment, the flange members 92 include a plurality of distally-extending fingers 102 or hooks that curve downward to form recesses 106. The recesses 106 each receive and removably secure a pin 42 to mount the shelf 54 to the post 22, preventing translational and rotational movement of the shelf due to loading forces. The fingers 102 or hooks can be equally or unequally spaced but are positioned to correspond to the support pins 42.

Figure 7:
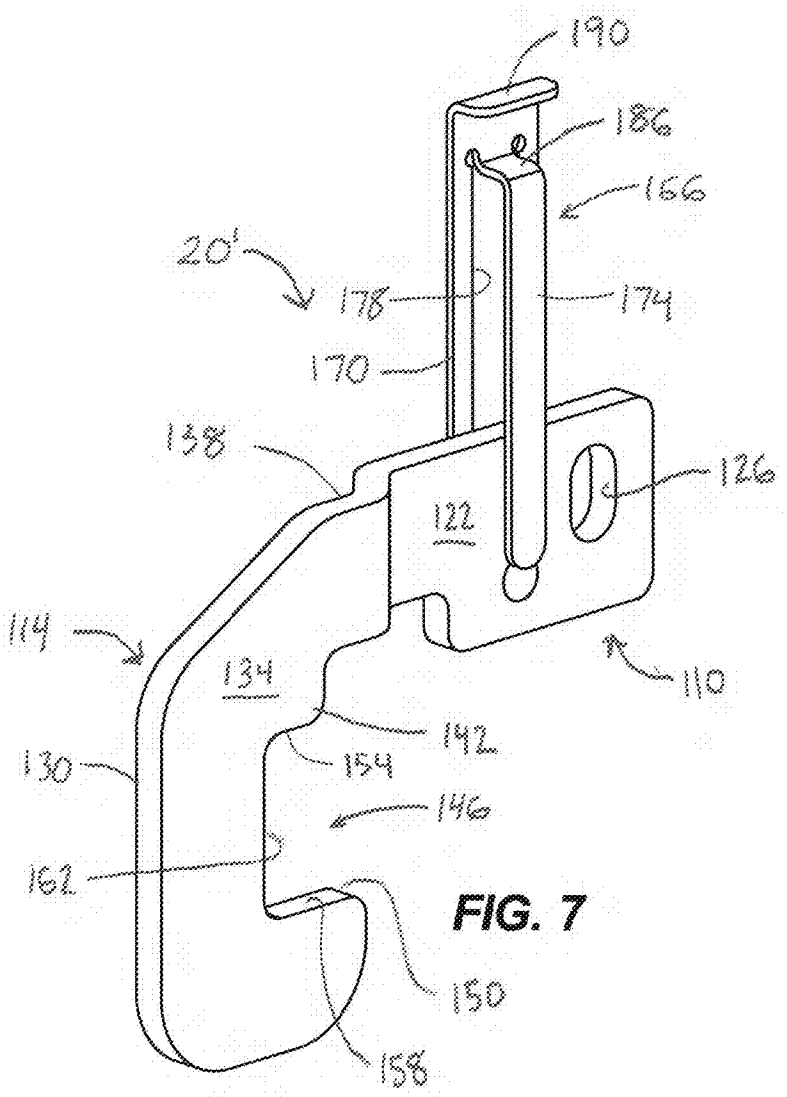
FIG. 7 is another perspective view of the support bracket of FIG. 6.

The support bracket 20, to be hereinafter described with reference to FIGS. 2-5, 8, and 9, is configured as a left-side bracket for coupling generally to the left side 16 of the shelving system 10. FIGS. 6 and 7 illustrate another support bracket 20' configured as a right-side support bracket for coupling generally to the right side of the shelving system 10. In other embodiments, the support brackets 20, 20' can be incorporated into the shelving system individually (e.g., for a shelving system having a single support post). The support bracket 20' of FIGS. 6 and 7 is a mirror image of the support bracket 20. As such, the support bracket 20' will not be described in detail herein, and like features of the support brackets 20 and 20' have been given like reference numerals. Although the support bracket 20 is described with respect to the shelving system 10 illustrated in FIG. 1, it should be understood that various embodiments of the support bracket 20 can be used with other types of shelving systems.

The support bracket 20 includes an attachment portion 110 and a support portion 114 continuously extending from the attachment portion 110. The attachment portion 110 includes a first side 118, a second side 122 opposite the first side 118, and an aperture 126 extending from the first side 118 to the second side 122. The aperture 126 is configured to receive a pin 42 projecting from the post 22 to couple the attachment portion 110 to the post 22. In other embodiments, the attachment portion 110 can be sized to include two or more apertures 126 to receive two or more pins 42 of the post 22. Alternative engagement features for coupling the attachment portion 110 with the post 22 or with posts of other shelving systems are within the scope of the present invention.

In the illustrated embodiment, the support bracket 20 is positioned on the post 22 with the second side 122 of the attachment portion 110 generally parallel and adjacent to the post 22, specifically the right side 38 of the post 22 (or the left side 34 for a support bracket 20'). The attachment portion 110 is positioned vertically adjacent the flange member 92 of a lateral bracket 58, and the aperture 126 of the attachment portion 110 receives the pin 42*a* adjacent the pin 42*b* engaged with the fingers 102 on the flange member 92, as illustrated in FIG. 2. As such, a portion of the support bracket 20 is positioned directly above the shelf 54. As shown in FIGS. 2 and 3, the attachment portion 110 abuts the top side 98 of the flange member 92, but in other embodiments, the attachment portion 110 can be spaced from the top side 98 of the flange member 92 and need not receive the pin adjacent the pin 42*b* (e.g., dependent on the spacing of the pins 42, the position of the aperture 126, or the shape of the attachment portion 110). In yet other embodiments, by varying the connection of the attachment portion 110 to the support portion 114, the support bracket 20 can be coupled to the post 22 such that the second side 122 of the attachment portion 110 is positioned laterally adjacent the flange member 92. In such an embodiment, the attachment portion 110 and the flange member 92 can be coupled to the same pin(s) 42.

Figure 5:
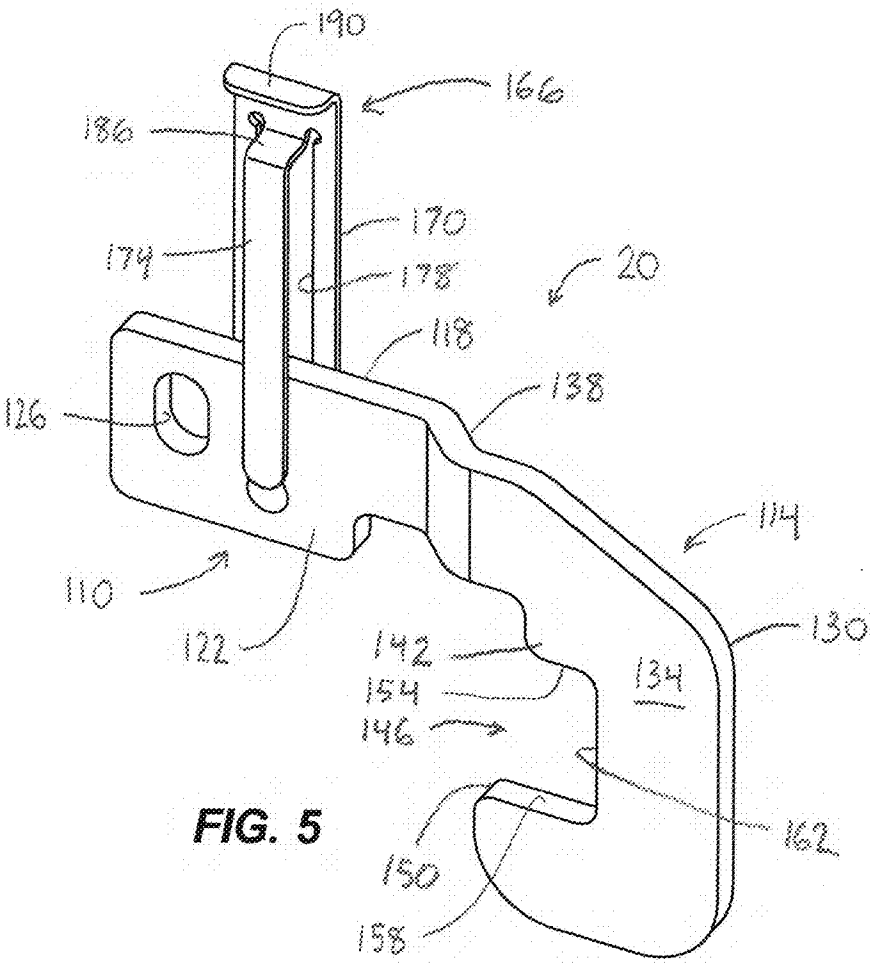
FIG. 5 is another perspective view of the support bracket of FIG. 2.
Figure 4:
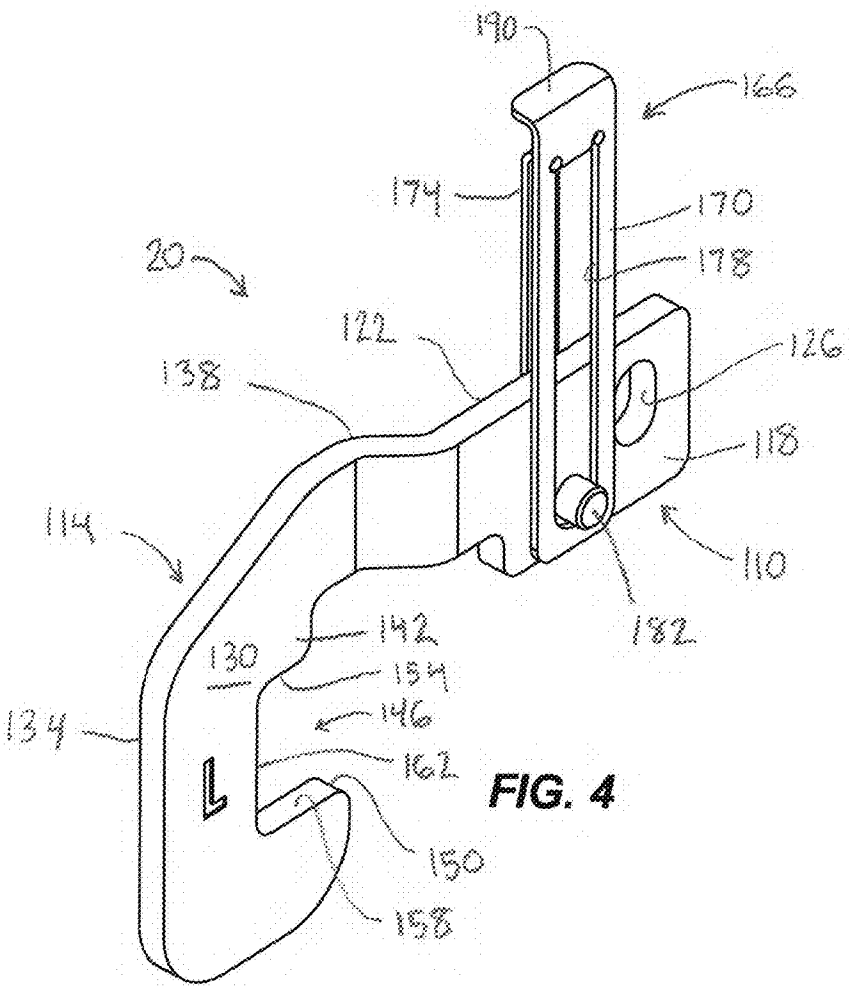
FIG. 4 is a perspective view of the support bracket of FIG. 2.
Figure 6:
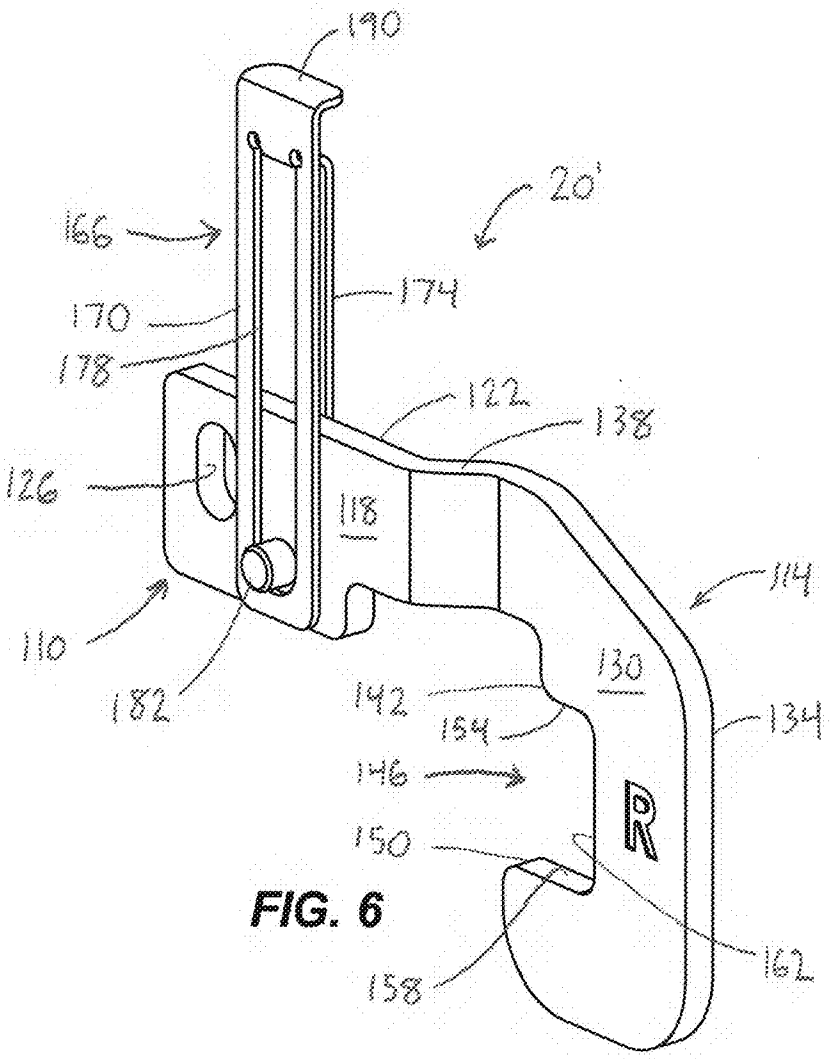
FIG. 6 is a perspective view of another support bracket for use with the shelving system of FIG. 1.
Figure 9:
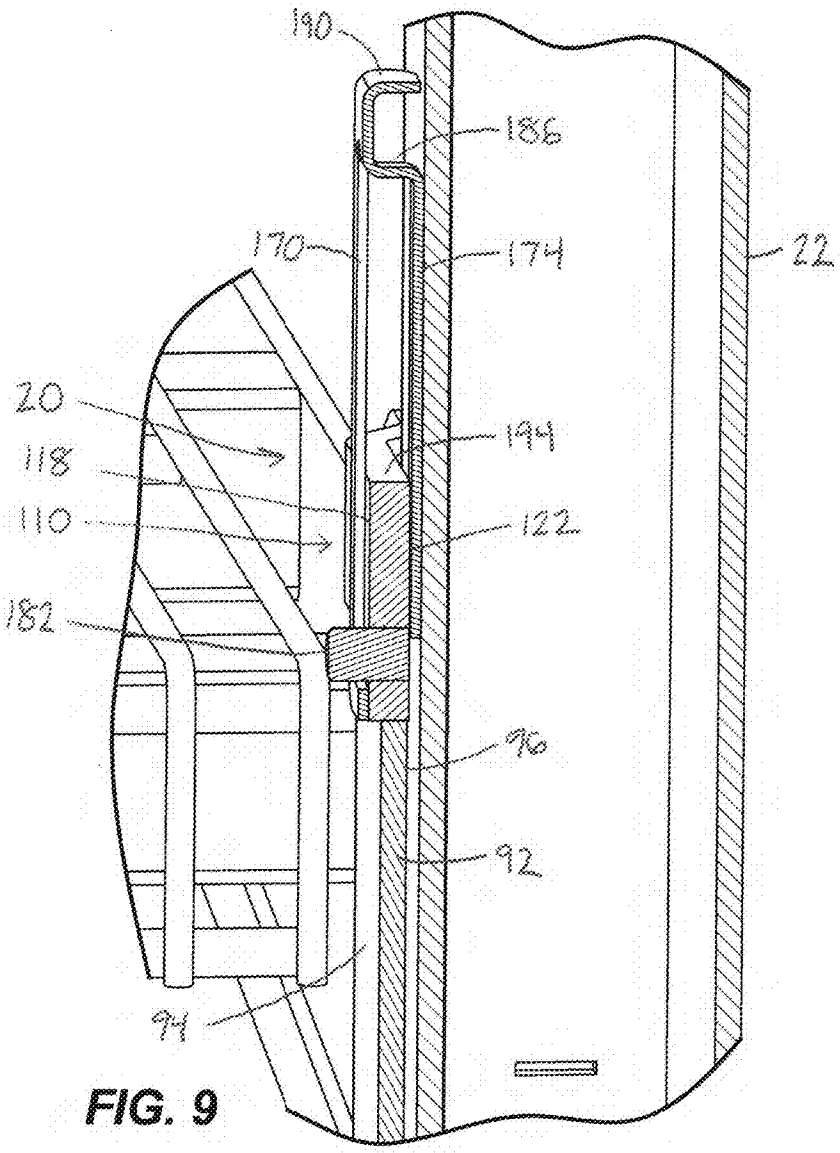
FIG. 9 is a cross-sectional view of a portion of the shelving system of FIG. 1, showing the lock member of the support bracket in an unlocked position.

Referring to FIGS. 4 and 5, the support portion 114 includes a first side 130 substantially parallel with the first side 118 of the attachment portion 110, and a second side 134 opposite the first side 130. A curved transition region 138 offsets the attachment portion 110 from the support portion 114. In other embodiments, the first and second sides 130, 134 of the support portion 114 can be generally coplanar with the first and second sides 118, 122 of the attachment portion 110. The support portion 114 further includes a generally C-shaped region 142 extending downward from the support portion (relative to the orientation of FIGS. 4 and 5). The C-shaped region 142 forms a recess 146 having an opening 150 oriented toward the attachment portion 110. The recess 146 is further defined by an upper wall 154, a lower wall 158, and an intermediate wall 162 extending between the upper wall 154 and the lower wall 158. The walls 154, 158, and 162 are configured to engage the distal support member 62*a* of the shelf 54 (when mounted to the post 22). Accordingly, in other embodiments, the recess 146 can have other shapes and/or orientations suitable to engage with the support member 62*a* or other shaped or sized member extending between lateral brackets 58 and supporting or otherwise forming the support surface cover or platform 66 upon which to store and/or display articles. For example, in some embodiments, the recess 146 can include a single curved wall to engage with a support member having a circular cross-section. In other embodiments with alternative mounting of the attachment portion 110, the C-shaped region 142 can extend upward from the support portion 114 to engage the support member 62*a*.

With reference to FIG. 3, the recess 146 of the support portion 114 is disposed about a portion of the distal support member 62*a* of the shelf 54 to engage and secure or otherwise support the support member 62*a* when the support bracket 20 is installed on the post 22. The upper wall 154 is positioned adjacent the top side 78 of the distal support member 62*a*, the intermediate wall 162 is positioned adjacent the proximal side 74 of the distal support member 62*a*, and the lower wall 158 is positioned adjacent the bottom side 82 of the distal support member 62*a*, i.e., the support portion 114 is disposed substantially about the support member 62*a*. At least one of the sides (e.g., the bottom side 82 and/or the proximal side 74) of the distal support member 62*a* contacts or bears against the adjacent wall (i.e., the lower 158 and/or intermediate wall 162) to transmit loading from the lateral bracket 58 through the distal support member 62*a* to the support bracket 20. The support bracket 20 then transmits this loading to the support post 22. Accordingly, the support bracket 20 reduces the stresses experienced by the lateral bracket 58 and strengthens the shelving system 10.

The support brackets 20, 20' are preferably formed from a single piece of metal, for example, by a stamping or cutting process.

Referring to FIGS. 4, 5, 8, and 9, the support bracket 20 includes a lock member 166 slidable relative to the support bracket 20 between an unlocked position (FIG. 9) in which the lock member 166 permits movement of the support bracket 20 relative to the flange member 92 and a locked position (FIG. 8) in which the lock member 166 inhibits movement of the support bracket 20 relative to the flange member 92. The lock member 166 includes a first leg 170 adjacent the first side 118 of the attachment portion 110 and a second leg 174 adjacent the second side 122 of the attachment portion 110. The first leg 170 includes a slot 178 extending therethrough, which receives a laterally extending projection 182 of the attachment portion 110 to couple the lock member 166 to the attachment portion 110. The slot 178 is slidable along the projection 182 as the lock member 166 moves between the locked position and the unlocked position. The lock member 166 also includes a connecting portion 186 extending between the first and second legs 170, 174, and an upper surface 190 extending generally perpendicular to the legs 170, 174 to facilitate positioning of the lock member 166. In the illustrated embodiment, the lock member 166 is integrally formed from a single piece of metal. For example, the second leg 174 can be stamped or cut from the first leg 170 to thereby define the slot 178, then bent to laterally offset the second leg 174 from the first leg 170, forming the connecting portion 186. In other embodiments, the lock member 166 can be formed from multiple pieces and/or through any suitable process.

Figure 8:
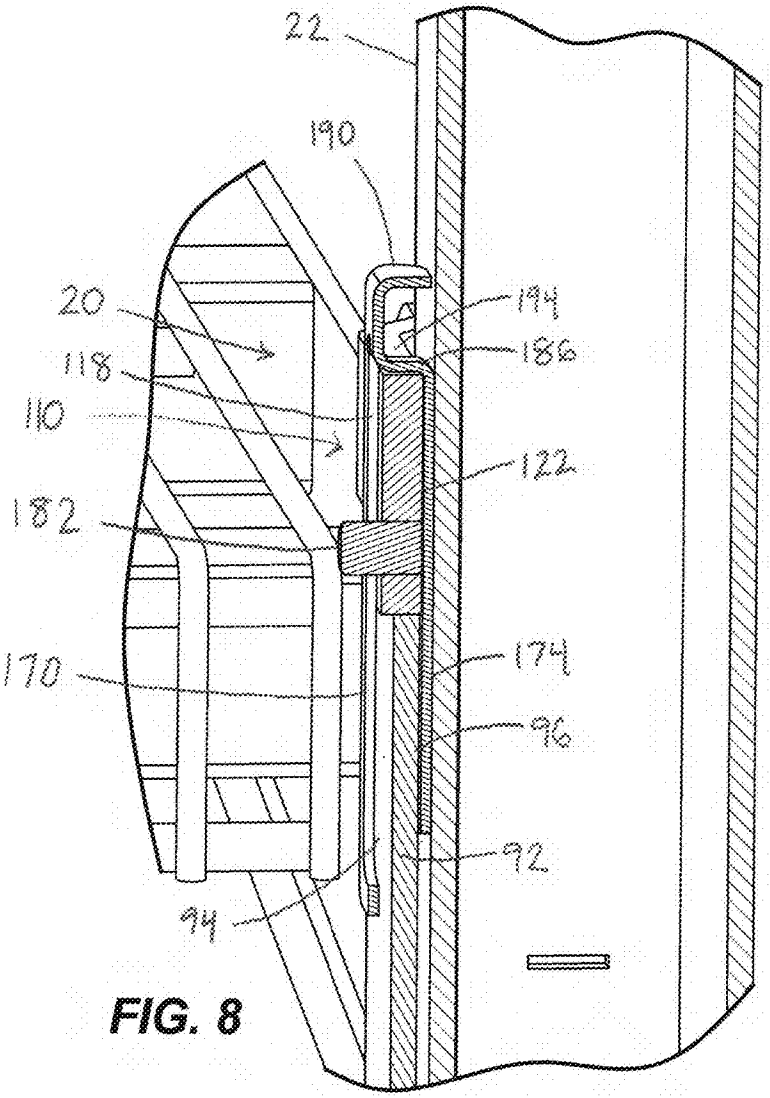
FIG. 8 is a cross-sectional view of a portion of the shelving system of FIG. 1, showing a lock member of the support bracket in a locked position.

With reference to FIG. 8, in the locked position, the connecting portion 186 of the lock member 166 abuts a top side 194 of the attachment portion 110 to provide an indication that the lock member 166 is fully engaged in the locked position. In the locked position of FIG. 8, the first leg 170 of the lock member 166 spans across both the first side 118 of the attachment portion 110 and the first side 94 of the flange member 92. Similarly, the second leg 174 of the lock member 166 spans across the second side of the attachment portion and the second side 96 of the flange member 92, disposed in the space defined between the surface 122 of bracket 20 and surface 96 of flange member 92, on the one hand, and the surface 38 of support post 22, on the other hand. As such, the attachment portion 110 and the flange member 92 are captured between the first and second legs 170, 174 of the lock member 166 and held in alignment. This prevents lateral movement of the support bracket 20 relative to the flange member 92 and keeps the bracket 20 in its optimal position for providing support to the shelf 54.

The support brackets 20 and 20' thereby assist in mitigating the mechanical stresses developed in the lateral brackets 58 due to shelf loading, such as impact loading, by providing a countering force to such loading. The support bracket can be readily installed without the need for any tools or external devices to new or existing shelving systems having a variety of different configurations, shelf depths, and lengths.

Various features of the invention are set forth in the following claims.

What is claimed is:

1. A shelving system comprising:

two support posts, each support post comprising an interior surface, an exterior surface, a front surface, a back surface, and a mounting portion comprising a plurality of support pins fixed to the support post and extending outwardly away from at least one of the interior and exterior surfaces;

a shelf comprising two lateral cantilever brackets and a support member extending between the two lateral cantilever brackets defining a planar support surface of the shelf;

wherein each lateral cantilever bracket comprises:

(i) a proximal end having a first thickness given by a distance between a top and bottom surface of the lateral cantilever bracket at the proximal end;

(ii) a distal end having a second thickness given by a distance between a top and bottom surface of the lateral cantilever bracket at the distal end, wherein the second thickness is less than the first thickness; and (iii) a flange extending from the proximal end of the lateral cantilever bracket, wherein the flange is configured for releasable attachment with any one support pin of the plurality of support pins fixed to one of the support posts, and wherein in an assembled state of the shelving system, the flange of the lateral cantilever bracket abuts the front surface of one of the support posts and at least one of the interior and exterior surfaces of one of the support posts; and a support element comprising an attachment portion and a support portion continuously extending from the attachment portion, wherein the attachment portion is configured for releasable attachment with a support pin of the plurality of support pins fixed to one of the support posts, and wherein in an assembled state of the shelving system, the support portion of the support element comprises a region that is substantially parallel to the front surface of one of the support posts and the attachment portion of the support element abuts a flange of one of the lateral cantilever brackets; and wherein in an assembled state of the shelving system the shelving system comprises a plane comprising the front surfaces of the support posts and a planar surface extending therebetween, and the top surfaces of the lateral cantilever brackets and the planar support surface of the shelf are orthogonal to the plane.

2. The shelving system of claim 1, wherein the support pins are spaced a distance of between about one inch and about four inches along the length of each support post.

3. The shelving system of claim 1, wherein the support pins are spaced equally from each other.

4. The shelving system of claim 1, wherein the support pins are spaced unequally from each other.

5. The shelving system of claim 1, wherein the mounting portion comprises a plurality of support pins fixed to a respective support post and extending outwardly away from both of the interior and exterior surfaces.

6. The shelving system of claim 5, wherein a flange is configured for releasable attachment with at least one pair of support pins, the at least one pair of support pins comprising a first support pin extending outwardly away from the interior surface and a second support pin extending outwardly away from the exterior surface, and wherein the first and second support pins are located at the same height on the respective support post.

7. The shelving system of claim 1, wherein the support member is selected from the group consisting of a frame, a sheet, a plurality of bars, a mesh, a screen, and a grate.

8. The shelving system of claim 1, wherein each lateral cantilever bracket is formed from a single piece of metal.

9. A shelving assembly for a shelving system having two support posts, each support post comprising an interior surface, an exterior surface, a front surface, a back surface, and a mounting portion comprising a plurality of support pins fixed to the support post and extending outwardly away from at least one of the interior and exterior surfaces, the shelving assembly comprising:

two lateral cantilever brackets and a support member extending between the two lateral cantilever brackets defining a planar support surface of the shelving assembly;

wherein each lateral cantilever bracket comprises:

(i) a proximal end having a first thickness given by a distance between a top and bottom surface of the lateral cantilever bracket at the proximal end;

(ii) a distal end having a second thickness given by a distance between a top and bottom surface of the lateral cantilever bracket at the distal end, wherein the second thickness is less than the first thickness; and (iii) a flange extending from the proximal end of the lateral cantilever bracket, wherein the flange is configured for releasable attachment with any one support pin of the plurality of support pins fixed to one of the support posts, and wherein in an assembled state of the shelving system, the flange of the lateral cantilever bracket abuts the front surface of one of the support posts and at least one of the interior and exterior surfaces of one of the support posts; and a support element comprising an attachment portion and a support portion continuously extending from the attachment portion, wherein the attachment portion is configured for releasable attachment with a support pin of the plurality of support pins fixed to one of the support posts, wherein in an assembled state of the shelving system, the support portion of the support element comprises a region that is substantially parallel to the front surface of one of the support posts and the attachment portion of the support element abuts a flange of one of the lateral cantilever brackets; and wherein in an assembled state of the shelving system the shelving system comprises a plane comprising the front surfaces of the support posts and a planar surface extending therebetween, and the top surfaces of the lateral cantilever brackets and the planar support surface of the shelving assembly are orthogonal to the plane.

10. The shelving assembly of claim 9, wherein the mounting portion comprises a plurality of support pins fixed to a respective support post and extending outwardly away from both of the interior and exterior surfaces, wherein a flange is configured for releasable attachment with at least one pair of support pins, the at least one pair of support pins comprising a first support pin extending outwardly away from the interior surface and a second support pin extending outwardly away from the exterior surface, and wherein the first and second support pins are located at the same height on the respective support post.

11. The shelving assembly of claim 9, wherein the support member is selected from the group consisting of a frame, a sheet, a plurality of bars, a mesh, a screen, and a grate.

12. The shelving assembly of claim 9, wherein each lateral cantilever bracket is formed from a single piece of metal.

13. A cantilever bracket assembly configured for releasable attachment with a support post of a shelving system, wherein the support post comprises an interior surface, an exterior surface, a front surface, a back surface, and a mounting portion comprising a plurality of support pins fixed to the support post and extending outwardly away from at least one of the interior and exterior surfaces, the cantilever bracket assembly comprising:

a cantilever bracket comprising:

(i) a proximal end having a first thickness given by a distance between a top and bottom surface of the cantilever bracket at the proximal end;

(ii) a distal end having a second thickness given by a distance between a top and bottom surface of the cantilever bracket at the distal end, wherein the second thickness is less than the first thickness; and (iii) a flange extending from the proximal end of the cantilever bracket, wherein the flange is configured for releasable attachment with any one support pin of the plurality of support pins fixed to the support post; and a support element comprising an attachment portion and a support portion continuously extending from the attachment portion, wherein the attachment portion is configured for releasable attachment with a support pin of the plurality of support pins fixed to the support post; and wherein, when the cantilever bracket assembly is attached to the support post:

(a) the flange of the cantilever bracket abuts the front surface of the support post and at least one of the interior and exterior surfaces of the support post;

(b) the top surface of the cantilever bracket is orthogonal to the front surface of the support post;

(c) the support portion of the support element comprises a region that is substantially parallel to the front surface of the support post; and (d) the attachment portion of the support element abuts the flange of the cantilever bracket.

14. The cantilever bracket of claim 13, wherein the mounting portion of the support post comprises a plurality of support pins fixed to the support post and extending outwardly away from both of the interior and exterior surfaces, wherein the flange is configured for releasable attachment with at least one pair of support pins, the at least one pair of support pins comprising a first support pin extending outwardly away from the interior surface and a second support pin extending outwardly away from the exterior surface, and wherein the first and second support pins are located at the same height on the support post.

15. The cantilever bracket of claim 13, wherein the cantilever bracket is formed from a single piece of metal.

16. The cantilever bracket of claim 13, wherein the cantilever bracket comprises a side surface extending between the top and bottom surfaces of the cantilever bracket, and wherein the side surface is configured to be orthogonally coupled to a support member.

17. The cantilever bracket of claim 16, wherein the support member is selected from the group consisting of a frame, a sheet, a plurality of bars, a mesh, a screen, and a grate.

* * * * *